US005371521A

United States Patent [19]

Wehrmann

[11] Patent Number: 5,371,521

[45] Date of Patent: Dec. 6, 1994

[54] PACKAGING MACHINE WITH THERMAL IMPRINTER AND METHOD

[75] Inventor: Rick S. Wehrmann, Hudson, Ohio

[73] Assignee: Automated Packaging Systems, Inc., Twinsburg, Ohio

[21] Appl. No.: 861,597

[22] Filed: Apr. 1, 1992

[51] Int. Cl.[5] ..... B61J 2/32

[52] U.S. Cl. ..... 346/76 PH; 400/611; 400/514; 400/618; 101/228; 226/113; 53/459; 53/469; 53/477; 346/134; 346/136

[58] Field of Search ..... 346/134, 136, 76 PH; 53/459, 469, 477; 400/120, 611, 614; 101/228; 226/113

[56] References Cited

U.S. PATENT DOCUMENTS

| | | |
|---|---|---|
| 704,449 | 7/1902 | Edwards . |
| 1,305,235 | 5/1919 | Plass . |
| 1,905,446 | 4/1933 | Dewey et al. . |
| 1,978,073 | 10/1934 | Belcher . |
| 1,978,715 | 10/1934 | Meisel . |
| 2,084,827 | 6/1937 | Schwartz et al. . |
| 2,089,747 | 8/1937 | Grossmith . |
| 2,614,456 | 10/1952 | Zeuthen . |
| 2,714,268 | 8/1955 | Battey . |
| 2,758,541 | 8/1956 | Tison . |
| 2,858,131 | 10/1958 | Leshner . |
| 3,049,078 | 8/1962 | Smith, Jr. . |
| 3,084,841 | 4/1963 | Hata et al. . |
| 3,102,673 | 9/1963 | Aronson et al. . |
| 3,254,828 | 6/1966 | Lerner . |
| 3,426,680 | 2/1969 | Kaufmann . |
| 3,743,567 | 7/1973 | Abler . |
| 3,965,653 | 6/1976 | Lerner . |
| 3,972,460 | 8/1976 | Kesinger et al. . |
| 4,033,092 | 7/1977 | Vetter . |
| 4,070,951 | 1/1978 | Bala . |
| 4,071,178 | 1/1978 | Copp . |
| 4,358,336 | 11/1982 | Focke et al. . |
| 4,420,268 | 12/1983 | Tsukamura et al. . |
| 4,458,470 | 7/1984 | Fine . |
| 4,505,603 | 3/1985 | Yana . |
| 4,547,778 | 10/1985 | Erlichman et al. . |
| 4,548,024 | 10/1985 | Fine . |
| 4,551,729 | 11/1985 | Kubo et al. . |
| 4,586,834 | 5/1986 | Hachisuga et al. . |
| 4,642,265 | 2/1987 | Shibuya et al. . |

(List continued on next page.)

FOREIGN PATENT DOCUMENTS

| | | |
|---|---|---|
| 251448 | 1/1988 | European Pat. Off. . |
| 311981 | 4/1989 | European Pat. Off. . |
| 2570564 | 3/1986 | France . |
| 922413 | of 0000 | Germany . |
| 2155711 | of 0000 | Germany . |
| 1149718 | of 0000 | United Kingdom . |
| 2150886 | of 0000 | United Kingdom . |

OTHER PUBLICATIONS

EPO–Search Report (Appln. 93302583.5).

*Primary Examiner*—Benjamin R. Fuller
*Assistant Examiner*—Huan Tran
*Attorney, Agent, or Firm*—Watts, Hoffmann, Fisher & Heinke Co.

[57] ABSTRACT

A thermal transfer printing apparatus for printing an elongate continuous web of items. The apparatus comprises a frame structure having an imprinter mounted thereon. A plurality of idlers supports the web of items and defines a path of travel for the web. A segment of the path of travel is adjacent the imprinter and its print head. A rockable arm is connected to the frame structure and contacts the web along a top surface of the web at two locations. A first of the locations is upstream of the print head and a second of the locations is downstream of the print head. The arm is connected to the frame structure about a pivot point and rocks about this pivot point during operation of the apparatus in a manner similar to a "teeter-totter." A stepper motor drives two drive rollers thereby advancing the web. When a selected item is in a proper printing position within the segment of the path of travel adjacent the imprinter, air cylinders actuate a nip and the print head against the drive rollers to maintain proper tension within the selected item. The rockable arm then rocks about its pivot point and the stepper motor drives the drive rollers to pull the selected item past the print head so that the item may be imprinted.

32 Claims, 7 Drawing Sheets

U.S. PATENT DOCUMENTS 4,642,658 2/1987 Arakawa .
4,655,129 4/1987 Wirth et al. .
4,659,416 4/1987 Johansson .
4,675,700 6/1987 Nagira et al. .
4,695,850 9/1987 Nubson .
4,703,346 10/1987 Bierhoff .
4,711,562 12/1987 Pothast et al. .
4,760,405 7/1988 Nagira et al. .
4,778,093 10/1988 Renold .
4,781,481 11/1988 Nagahamaya .
4,784,502 11/1988 Kobayashi .
4,788,558 11/1988 Caldwell et al. .
4,899,520 2/1990 Lerner et al. .
5,251,988 10/1993 Frazier .

PACKAGING MACHINE WITH THERMAL IMPRINTER AND METHOD

TECHNICAL FIELD

This invention relates generally to a packaging machine equipped with a printing apparatus and, more particularly, to the control of the feed of a web to be imprinted by a thermal imprinter as it is fed along a path of travel.

BACKGROUND OF THE INVENTION

In packaging and other operations, long, continuous chains of items such as labels and bags and other webs often have information such as the part number of a product being packaged printed directly thereon. Thermal imprinters are frequently utilized for such printing. Thermal imprinters operate by bringing the item to be printed into contact with a transfer material, such as foil, and applying heat with a print head at points of contact.

Problems associated with thermal imprinters include maintaining proper tension of the item being printed and maintaining the proper print area on each item. Additionally, movement of the foil between a supply reel and a take-up reel causes a static build-up due to the contact with the items. This problem is especially bad on cool and dry days and effects the electronics of the imprinter.

A proposed imprinter would have a paper sheet that is transported by a platen roller in conjunction with first and second pinch rollers. The pinch rollers would be positioned in parallel with a shaft of the platen roller on each side of the platen roller. The pinch rollers would be rotatably attached to respective pairs of substantially U-shaped arms that would be respectively mounted on each of two walls of a bracket. The arms would respectively be connected to the walls by springs so that the pinch rollers would urge the paper into contact with the surface of the platen roller. A pulse motor would selectively rotate its shaft in both clockwise and counterclockwise directions in accordance with supplied control signals. The platen roller would thereby cause the paper sheet to move in either a forward or backward direction. The pulse motor would receive signals which would cause the motor to drive the paper in either a forward or reverse direction as needed for printing.

Another proposed imprinter would utilize a microprocessor to compare the output of a paper take-up encoder with a stepper drive pulse count over a corresponding interval of time. The microprocessor would compare the output of the encoder and the drive pulse count to determine an indication of the current operating radius of paper wound upon a paper take-up reel. This comparison would be stored in a RAM. The microprocessor would then access a second function table stored in a ROM to determine the adjustment necessary in a take-up drive and thereby adjust the output torque of a take-up motor.

SUMMARY OF THE INVENTION

The present invention provides a thermal transfer printing apparatus for use with another type of machine, in this case a packaging machine, for printing a continuous web such as a chain of bags. The apparatus comprises a frame structure having an imprinter mounted thereon. The imprinter includes a print head, as well as a transfer material supply reel and a transfer material take-up reel for providing transfer material, typically in the form of foil. A plurality of idlers supports the web and defines a path of travel for the web of items. A segment of the path of travel is adjacent the imprinter and its print head.

A rockable arm is connected to the frame structure. The arm carries rollers that contact the web along a top surface of the web at spaced locations, one upstream of the print head and the other downstream of the print head. The arm is connected to the frame structure for rotation about a pivot axis and rocks about this pivot axis during a printing process in a manner similar to a "teeter-totter."

Two drive rollers are located along the path of travel and control the advance of the web during the printing process. The drive rollers are controlled by a stepper motor that operates the drive rollers intermittently to control web feed within the segment of the path of travel adjacent to the imprinter. The stepper motor preferably advances the drive rollers at least one step for each line printed by the print head during the printing process.

A nip is connected to the imprinter near an end opposite the print head and cooperates with one of the drive rollers to engage the web during the printing process thereby clamping the web between the nip and drive roller. The print head is positioned to engage the foil adjacent the second drive roller during the printing process thereby clamping the foil and web between the print head and the second drive roller. Movement of the nip and the print head are controlled by air cylinders.

Where precise registration of this printing is desired, a sensor is provided for sensing indicia on the web. The sensor controls the initiation operation of the imprinter in response to sensing such indicia.

During operation of the printing apparatus, when a selected portion of the web is in a proper printing position within the segment of the path of travel adjacent the imprinter, the air cylinders clamp the web between the print head and nip and their respectively associated drive rollers to maintain proper feed control of the selected portion as the printing process proceeds. The stepper motor drives the drive rollers and the rockable arm pivots about its pivot axis thereby controlling the intermittent advance of the web. The use of the rockable arm in conjunction with the print head and nip clamping of the web helps assure proper tension in the selected portion during printing as well as appropriate feed rate.

In the preferred embodiment, the transfer supply reel and the transfer take-up reel are isolated from the rest of the imprinter by a ground plane shield that separates the reels from the rest of the imprinter. This minimizes the subjection of the imprinter control electronics to static electricity generated during the printing process.

A further feature of the printing apparatus is the mounting of the imprinter on the frame structure. The imprinter is pivotally mounted near its downstream end to a shaft and is removably secured near its upstream end to another shaft. This allows the imprinter to be tilted forward about a pivot axis for easy access to the print head, which requires service from time to time for cleaning and repair.

Another feature of the present invention is the ability to mount two or more imprinters side by side on the same machine frame structure. This allows two or more webs to be fed through the machine simultaneously and be imprinted. Additionally, wide webs can be fed through the machine and can be imprinted at adjacent locations simultaneously by the multiple imprinters.

An adjustment arm is located along the path of travel downstream from the imprinter and is used to adjust the length of the path of travel section between the imprinter and, with the disclosed apparatus, a packaging station. The adjustment arm is adjusted according to the length of the items within the web and helps maintain proper coincident registration of a web portion to be imprinted and an item at a packaging or other downstream work station.

Accordingly, it is an object of the present invention to provide a packaging machine including an improved thermal imprinter having a novel system for advancement and control of a continuous web of items to be imprinted.

Additionally, it is an object of the present invention to provide an improved thermal imprinter apparatus having an easy-to-access thermal print head.

It is also an object of the present invention to provide an imprinter that has protection against static electricity that develops during operation of the imprinter.

DETAILED DESCRIPTION OF THE PREFERRED EMBODIMENT

Figure 1A:
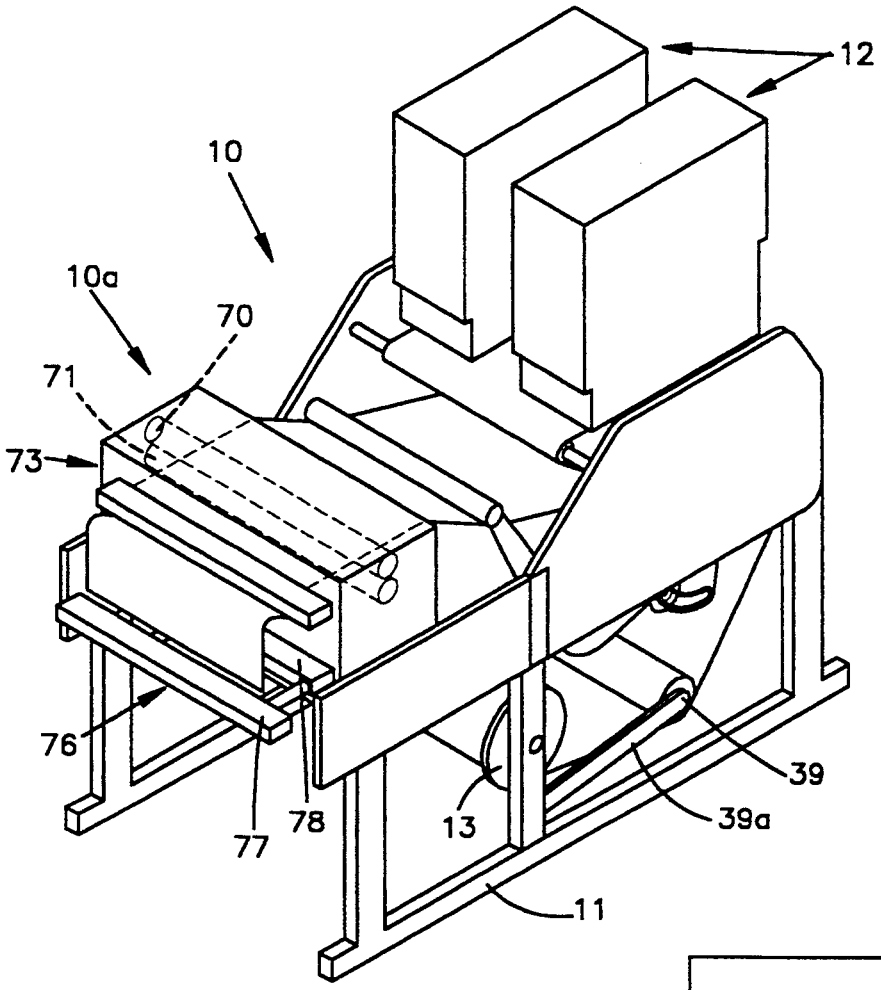
FIG. 1A is a perspective view of a packaging machine embodying the present invention.
Figure 1B:
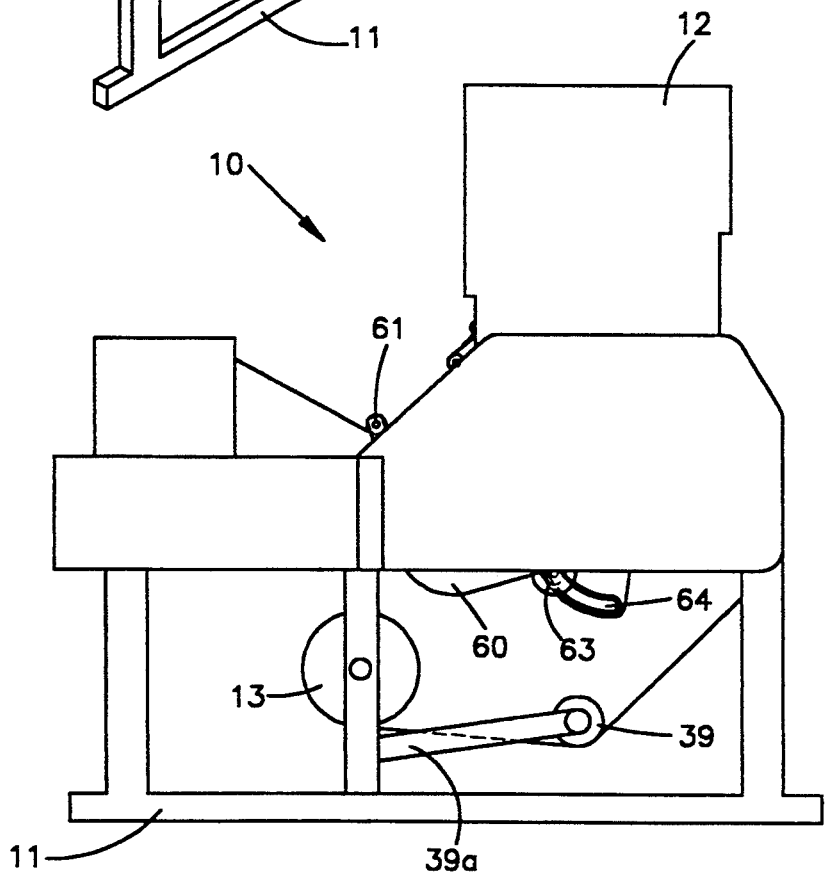
FIG. 1B is a side elevational view of a machine having a thermal imprinter embodying the present invention.

A packaging machine that handles continuous webs of interconnected plastic, pre-opened bags for loading the bags with product is illustrated generally at 10. The machine 10 includes a packaging station 10*a*, a frame structure 11 and an imprinter 12 mounted on the frame structure 11. The machine also includes a supply reel 13 for supplying a web of items W.

For purposes of this description, the machine 10 is a packaging machine as described and claimed in U.S. Pat. No. 3,965,653 entitled PACKAGING APPARATUS, and in other patents deriving from the applications that resulted in this patent, and has been sold commercially by Automated Packaging Systems, Inc. A machine described and claimed in U.S. Pat. No. 4,899,520 entitled PACKAGING APPARATUS AND METHOD functions in a manner similar to the machine described in U.S. Pat. No. 3,965,653 but has additional capabilities including the ability concurrently to utilize two chains of interconnected bags for "double up" packaging. The web W of bags that is preferably used with packaging machines of this type is disclosed and claimed in U.S. Pat. No. 3,254,828 entitled FLEXIBLE CONTAINER STRIPS. All three patents are incorporated herein by reference.

The imprinter 12 includes a transfer material supply reel 14 and a transfer material take-up reel 15. Transfer material T is fed between the transfer material supply reel 14 and the transfer material take-up reel 15 and is supported along a path between the two reels 14, 15. The path is defined in part by rolls 16, 17, 18. The transfer material is preferably any commercially available foil that is commonly used with thermal imprinters. A prototype machine 10 utilized foil supplied by International Imaging Materials Inc. (IIMAC), 310 Commerce Drive, Amherst, N.Y. 14228-2396, having part number FAP106PZ.

The transfer material take-up reel 15 and roll 16 are both driven. The take-up reel 15 is drivingly connected to a gear 20 by a belt 21. The belt 21 projects laterally from the gear 20 and take-up reel 15, and is at one end of the take-up reel 15 and gear 20. The gear 20 is in mesh with a drive gear 22 that is driven by a stepper motor (not shown). The driven roll 16 is drivingly connected to the drive gear 22 by a belt 23. The belt 23 projects laterally from the gear 22 and driven roll 16, and is at one end of the driven roll 16 and gear 22. Both belts 21, 23 are in a space approximately 3/16 of an inch wide.

The imprinter includes a print head 25 pivotally mounted at 27. A nip 24 is pivotally connected to the imprinter 12 at 26. Two air cylinders 30, 31 are located on the imprinter 12 above the nip 24 and the print head 25 respectively. A "doctor" blade 32 is located at a downstream end 33 of the imprinter 12 for separating the transfer material from the web after the printing process is complete. The transfer material travels around the blade 32 at a sharp angle.

Figure 2A:
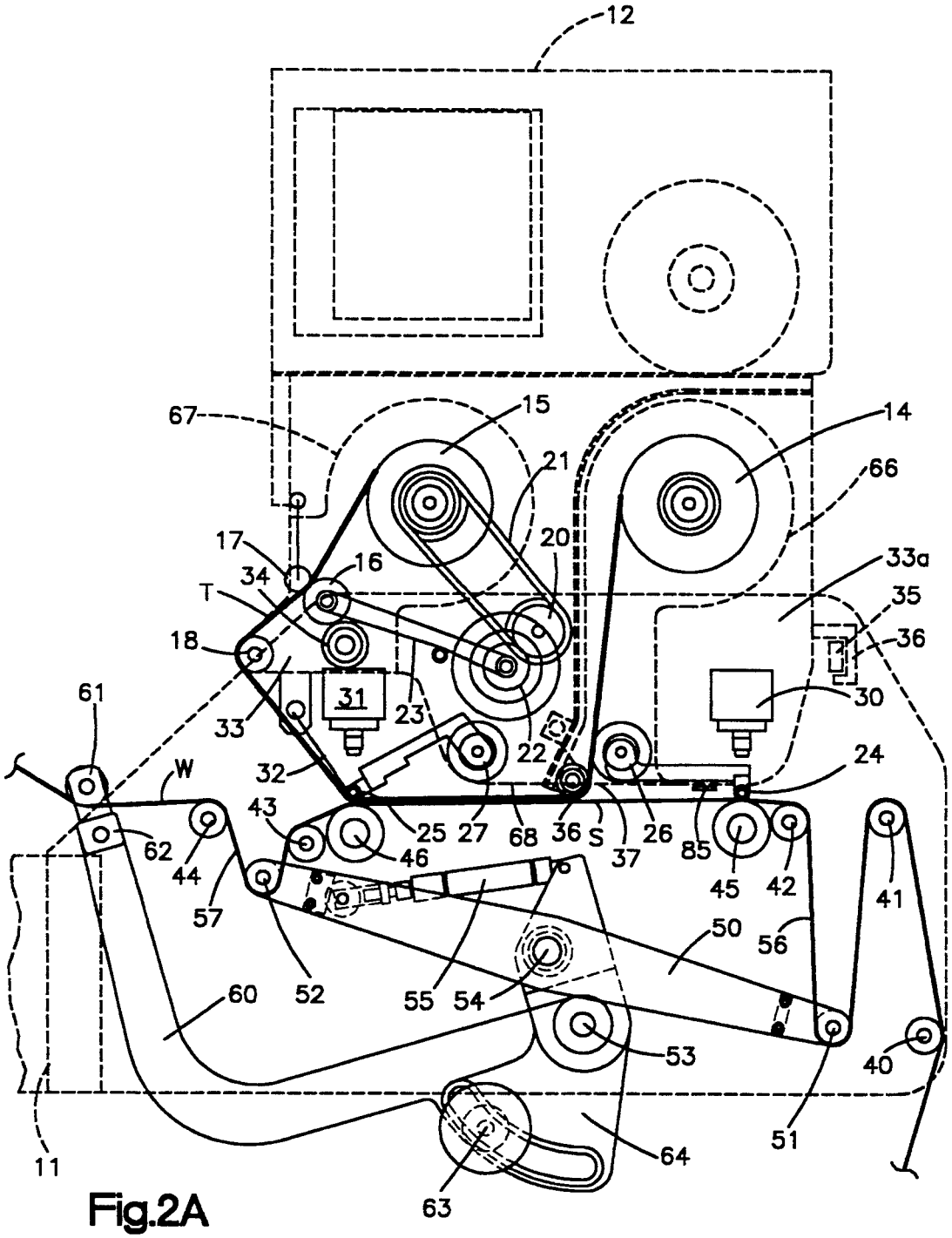
FIGS. 2A–2C are enlarged sectional views of a thermal imprinter embodying the present invention and illustrating operation of the imprinter.
Figure 2B:
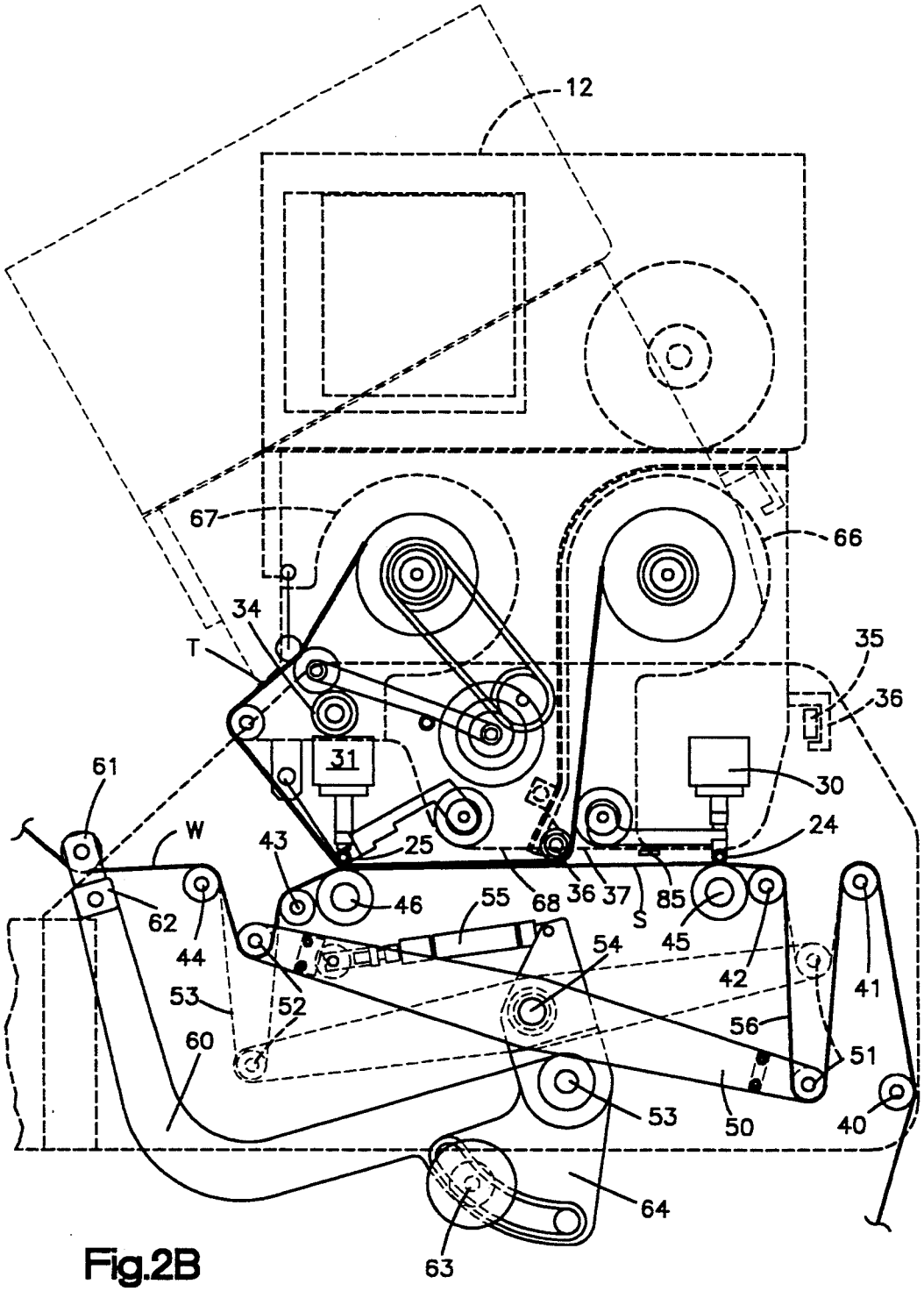
Figure 2C:
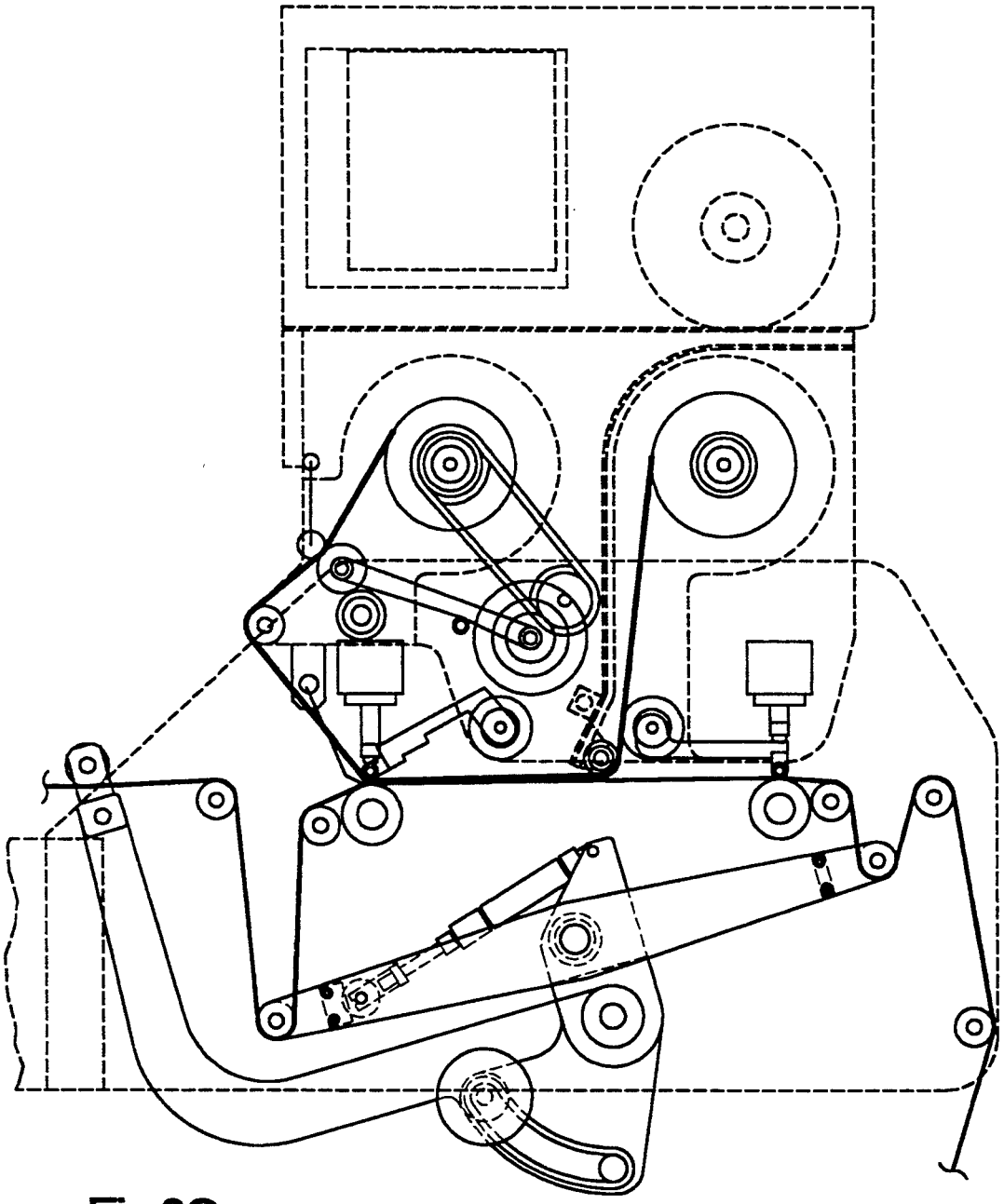

The imprinter 12 is pivotally mounted near its downstream end 33 to shaft 34. The imprinter 12 is releasably secured near its upstream end 33*a* to shaft 35 by a latch or clamp mechanism 36. The latch mechanism 36 holds the imprinter 12 in place and prevents lateral movement of the imprinter along shaft 34. As illustrated in FIG. 2B, release of the latch mechanism 36 disconnects the imprinter 12 from shaft 35, thereby allowing the imprinter to be tilted about shaft 34 for such things as access to print head 24, which requires service from time to time for cleaning and repair. The only requirement for tilting of the imprinter 12 other than release of the latch 36 is that the blade 32 be tilted forward.

The imprinter also includes a control panel 12*a* and a display 12*b*.

Figure 5:
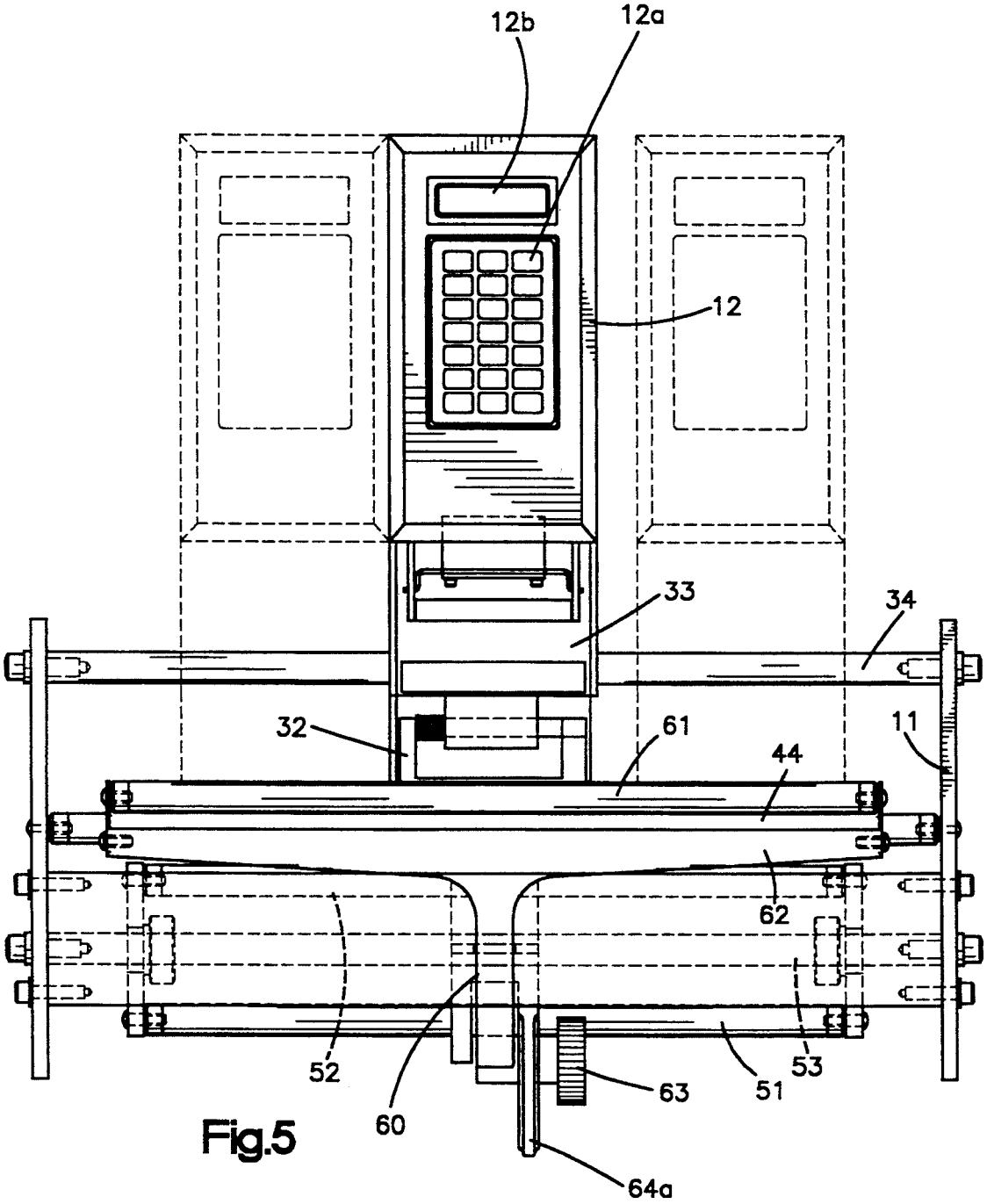
FIG. 5 is an end elevation view of a thermal imprinter embodying the present invention.

As illustrated in FIG. 1A and in phantom in FIG. 5, multiple imprinters 12 can be mounted on the machine 10. This allows wide webs to be imprinted at adjacent locations simultaneously by the multiple imprinters.-.Additionally, multiple webs can be processed through the machine 10 simultaneously with both webs being imprinted. Multiple imprinters can be mounted side by side because of the tall, narrow silhouette of each imprinter. The transfer material is slightly wider than the print head 24 and the imprinter 12 is slightly wider than the transfer material. In the preferred embodiment, 3/16 of an inch is provided between each outer edge 37, 38 of the imprinter 12 and the transfer material. This allows the imprinters to be mounted in a juxtaposed relationship by matching, and printing can be accomplished with only a separation of ⅜ of an inch between areas being printed.

The web W moves along a path of travel that is defined in part by a plurality of idlers 39, 40, 41, 42, 43, 44. The idlers guide and support the web as it moves from the supply reel 13 and under the imprinter during operation of the machine 10. Idler 39 is connected to the frame structure 11 by a dancer arm 39*a*. The idler 39 and dancer arm 39*a* help maintain proper tension within the web during advancement of the web through the machine 10.

Drive rollers 45, 46 are connected by belts 47, 48 to a stepper motor 49 to control the advance of a web section S adjacent the imprinter during operation of the imprinter. The drive rollers control the advance of the web such that a web portion to be printed is properly advanced at an appropriate rate as the printing by the print head 25 proceeds.

A rockable arm or "teeter-totter" 50 has spaced idlers 51, 52 journaled near its ends. The idlers 51, 52 engage the web along a top surface of the web. The teeter-totter 50 is mounted on a shaft 53. An air cylinder 55 is connected to the teeter-totter and is utilized to cause the teeter-totter to rock back and forth about a pivot 54.

The teeter-totter idlers 51, 52 respectively control the sizes of upstream and downstream web accumulator loops 56, 57. When the teeter-totter 50 is in a "home" position as illustrated in FIG. 2A, the upstream web accumulator loop 56 is of maximum size. After the teeter-totter is rocked to a second position (as illustrated in phantom in FIG. 2B), the upstream accumulator loop 56 has been reduced a given amount as the web section S is transferred past the imprinter 12 concurrently the downstream accumulator loop 57 has been increased by an amount equal to the size reduction of the upstream loop.

Figure 3:
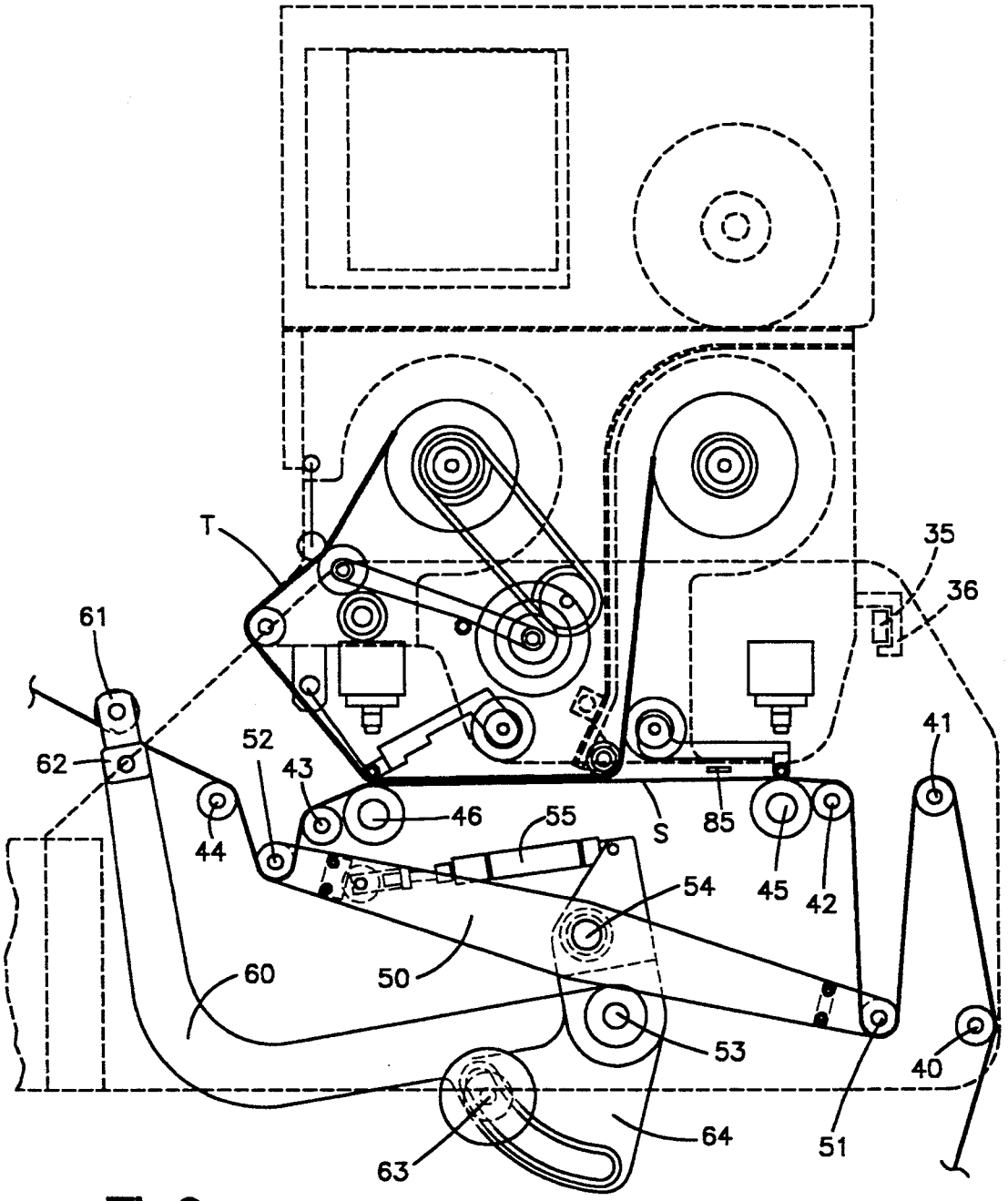
FIG. 3 is an enlarged sectional view of a thermal imprinter embodying the present invention further illustrating operation of the imprinter.
Figure 4:
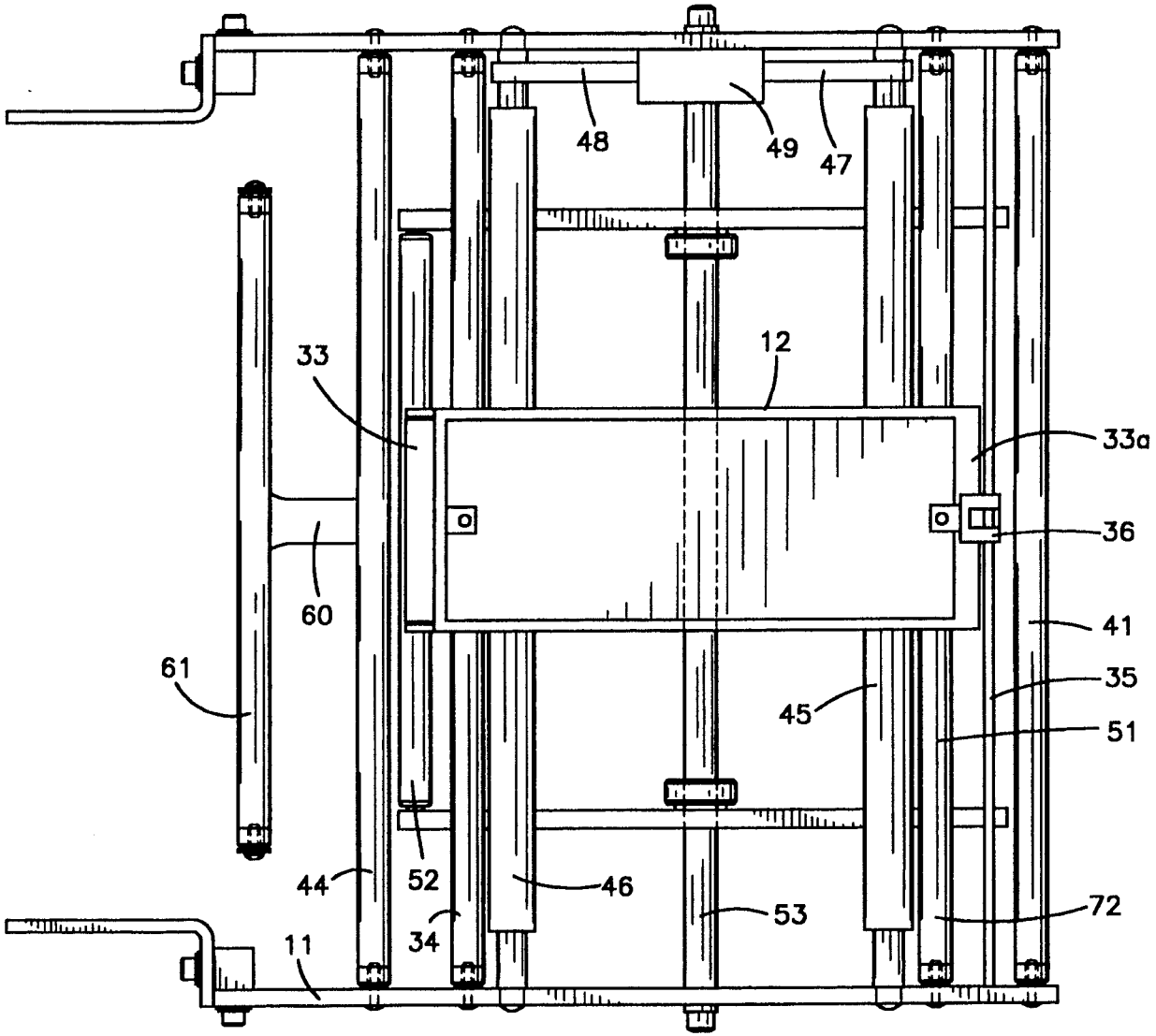
FIG. 4 is a top plan view of a thermal imprinter embodying the present invention.

An adjustment arm 60 is connected to the shaft 53. The adjustment arm 60 has a length control idler 61 located near an upper end of the adjustment arm. The web is fed under the idler 61 and above an upper portion 62 of the adjustment arm 60. The adjustment arm has an adjustment stop 63 which projects through and engages an adjustment slot 64 defined within support bracket 64*a*. By adjusting the adjustment arm 60 as illustrated in FIG. 3, the idler 61 raises or lowers the web downstream from the imprinter 12. The adjustment arm 60 is adjusted by manually loosening the stop 63 and moving the stop within the slot 64 and then retightening the stop. This adjustment is utilized to adjust the path length between the imprinter 12 and the station 10*a*. This path length adjustment enables concurrent registration of a bag at the packaging station 10*a* and the web section S to be imprinted. This path adjustment is necessary because the length of the individual bags within the web W for one packaging operation is often different than the bag length for another.

During operation of the imprinter, static electricity is generated by the separation of transfer material from the supply reel 14 as well as the contact between the transfer material T and the web W. The generation of static electricity is especially severe on cool, dry days. Static electricity may be damaging to or cause erratic operation by the electronics of the imprinter 12. Ground plane shields 66, 67 are therefore provided. The ground plane shields 66, 67 isolate the supply reel and take-up reels 14, 15 from the rest of the imprinter 12. Another ground plane shield 68 is located between the segment of the path of travel adjacent the imprinter and the imprinter itself. The ground plane shields protect the imprinter electronics from static electricity.

Referring to FIG. 1A, the packaging station 10*a* has feed rolls 70, 71 and a load station shown generally at 73. The feed rolls 70, 71 advance the web through the entire machine 10. The packaging station 10*a* also includes a sealing section 76 that seals loaded bags by clamping the bags between a seal bar 77 and a heater bar 78.

In operation, the web of items W is advanced along the path of travel defined by the idlers 39, 40, 41, 42, 43, 44, the drive rollers 45, 46 and the teeter-totter idlers 51, 52, the length control idler 61 and the feed rolls 70, 71, and into the load station 73. The feed rolls 70, 71 of the packaging station 10*a* draw the web through the machine 10 along the path of travel. When the feed rolls 70, 71 arrest feed of the web through the machine 10 to load a bag with product, control means including a detector preferably in the form of a spark gap detector (shown schematically at 75) within the packaging station 10*a* communicate with the electronics of the imprinter 12 and cause the air cylinders 30, 31 to move the print head 25 and nip 24 as illustrated in FIG. 2B (approximately $\frac{1}{4}$ of an inch) thereby isolating a selected bag (web section S) to be printed. The print head 25 clamps the transfer material T and web W against the drive roller 46 while the nip 24 clamps the web against the drive roller 45. The stepper motor 49 then drives the drive rollers 45, 46 as the air cylinder 55 causes the teeter-totter to pivot about pivot 54 as illustrated in FIG. 2B thereby advancing the web section S under the imprinter. This causes the selected bag to advance relative to the imprinter 12 and thereby the bag is advanced past the print head 25. The print head 25 prints on the selected bag by heating the transfer material.

During the printing process, the drive gear 22 drives the transfer material take-up reel 15 thereby advancing the transfer material T past the print head. As the transfer material passes the doctor blade 32, the sharp angle at which the transfer material passes the blade causes the transfer material T to separate from the web W. The manner of separation improves the print quality.

When the printing process is complete, the control means communicate with the imprinter to disengage the air cylinders 30, 31 from the print head 25 and nip 24. This "releases" the web so that the feed rolls 70, 71 can freely advance the web.

If two or more imprinters are utilized simultaneously, multiple teeter-totters 50 may be required for multiple, independent webs. In such instances, the control means will coordinate operation of the imprinters so that each web is properly imprinted as it advances through the machine. Alternatively, the imprinters may be in "communication" with one another to control proper imprinting for each web.

A prototype imprinter 12 has suitable electronics for operating the imprinter that have been developed and produced by MicroCom, 8333 Green Meadows Dr. North, Westerville, Ohio 43081. This is provided by electronics having part numbers 050012, 050013, 630002, 630003, 570017, 060013, 060014, 060015, 060016, 060017, 060018, 050005 and 040011.

An optional sensor 85 (shown schematically) can be added to improve the precision of the location of a web portion on which the imprinter will print. The web is positioned just prior to printing such that the indicia on a bag to be printed is rearward of the sensor 85 a distance large enough such that, within a range of tolerance, location of the indicia is always upstream from the sensor 85. Therefore, the indicia are separated a distance equal to a multiple of the bag length. As the bag to be printed is advanced under the imprinter, the sensor 85 helping assure correct registration of the imprinting on the selected bag. This allows a more precise placement of the printing on the bag.

Although the preferred embodiment of this invention has been shown and described, it should be understood that various modifications and rearrangements of the parts may be resorted to without departing from the scope of the invention as disclosed and claimed herein.

I claim:

1. A thermal transfer printing apparatus for printing an elongate web comprising:

a. a frame structure;

b. an imprinter mounted on the frame structure including a print head;

c. the imprinter including a transfer material supply reel for supplying transfer material;

d. the imprinter also including a transfer material take-up reel for taking up transfer material after it is used;

e. a plurality of idlers carried by the structure for guiding such web and defining a path of travel for such web, a segment of the path of travel being adjacent the imprinter and the print head;

f. a rockable arm assembly connected to the frame structure, the arm assembly being adapted to contact the web along a surface of the web at two locations, a first of the locations being upstream of the print head along the path and a second location being downstream of the print head along the path, the arm assembly being rockable during operation of said apparatus to pull a portion of such web through said segment and past the print head;

g. a stepper motor connected to the frame structure;

h. drive rollers driven by the stepper motor for controlling advance of the web through said segment; and, i. a nip connected to the imprinter, the nip and print head being cooperable with the drive rollers to isolate such web portion in a proper printing position relative to the print head and the rockable arm assembly, the nip and print head further cooperating with the drive rollers as well as the rockable arm assembly to maintain proper tension within such web portion during operation of the apparatus.

2. The apparatus of claim 1 wherein the imprinter is pivotally mounted on the frame structure.

3. The apparatus of claim 1 wherein the supply reel and take-up reel each are isolated within the imprinter by protective ground plane shielding.

4. The apparatus of claim 1 wherein the imprinter further includes sensing means for sensing indicia on such web portion during rocking of said arm to control operation of the imprinter.

5. A thermal transfer printing apparatus for printing an elongated web comprising:

a. a frame structure;

b. an imprinter mounted on the frame structure including a print head;

c. a transfer material supply reel connected to the imprinter for supplying transfer material, the supply reel being isolated from the print head by a protective ground shield to protect the imprinter from static electricity;

d. a transfer material take-up reel connected to the imprinter for taking up such transfer material after it is used, the take-up reel being isolated from the print head by a protective ground shield to protect the imprinter from static electricity;

e. structure defining a path of travel for the web and for supporting the web during operation of the apparatus, a segment of the path of travel being adjacent the print head; and, f. structure for advancing the web along the path of travel.

6. The apparatus of claim 5 wherein the imprinter is pivotally mounted on the frame structure.

7. A thermal printing apparatus for printing an elongated web comprising:

a. a frame structure;

b. an imprinter including a print head, the imprinter being pivotally mounted on the frame structure thereby providing easy access to the imprinter for service and maintenance;

c. other structure carried by the frame structure defining a path of travel for the web and for supporting the web during operation of the apparatus, a segment of the path of travel being adjacent the imprinter and the print head; and, d. a releasable clamp means is operatively interconnectable between the imprinter and the frame structure for securing the imprinter in an operation position for printing work pieces, the clamp means being releasable to permit the imprinter to be pivoted to a service and maintenance position.

8. For use with a packaging machine including a housing and frame structure, the machine being of a type with which a web in a form of a chain of preopened bags is fed from a supply to a load station for loading the bags with products sequentially and one at a time to form packages, an improved imprinting system comprising:

a. components connected to the structure and delineating a path of web travel through the machine;

b. a teeter-totter movably connected to the structure, the teeter-totter being positioned along a section of the path and carrying certain of said components;

c. an imprinter positioned along said section of the path;

d. film feed arresting means for selectively preventing the feed of the web both to and from said section; and e. power means operably connected to the teeter-totter for moving the teeter-totter and thereby causing said certain components to move a portion of such web disposed in said section relative to the imprinter as the arresting means prevents web feed to and from said section.

9. The system of claim 8 wherein at least one of said components is rotatable and connected to a rotation control means and said at least one of said components frictionally engages such web portion in said section to control the rate of movement of such web portion past the imprinter.

10. An improved packaging machine having web supply and bag loading stations connected to a housing and frame structure comprising:

a. a plurality of rolls connected to the housing and frame structure and establishing a path of web travel;

b. a web imprinter positioned along the path and including structure for selectively imprinting a section of a web as such web section is moved relative to the imprinter;

c. certain of said rolls establishing spaced accumulator loops of variable length portions of such web respectively positioned along the path upstream and downstream from the imprinter; and d. motive means for shifting at least some of said certain rolls to move such web section relative to the imprinter as the imprinter is operated, such section movement being accomplished by reducing the length of such web portion in one of said loops by a given amount while concurrently increasing the length of such web portion in another of said loops by an amount equal to said given amount.

11. The machine of claim 10 wherein the motive means includes a pivotally mounted teeter-totter carried by the structure and said at least some of the certain rolls are carried by the teeter-totter.

12. The machine of claim 10 wherein a section feed rate control means is provided and comprises a pair of said rolls positioned on either side of said web and gripping the web therebetween and a rotation, rate control mechanism operably connected to at least one of the rolls of the pair.

13. An improved packaging machine comprising:

a. a housing and frame structure;

b. a web supply support carried by the structure;

c. bag positioning and opening mechanism carried by the structure and delineating a loading station;

d. elements operably connected to the structure and delineating a path of web travel from the support to the station;

e. an imprinter carried by the structure and positioned along a section of the path;

f. at least two of said elements being carried by the imprinter;

g. a pair of said elements being respectively arranged with said at least two elements in opposed sets, the elements of the opposed sets being positioned on opposite sides of the path;

h. opposed set clamping means operatively connected to the sets and adapted to selectively cause the sets to clamp a portion of a web in the path section between the elements of each set;

i. two other of the elements being a spaced pair of loop-establishing elements respectively positioned along the path upstream and downstream of the path section, the loop-establishing elements being positioned to establish upstream and downstream variable path length loop portions of the path;

j. loop size control means carried by the structure and operably connected to loop-establishing elements for increasing the path length of one of the loop portions a given amount while concurrently reducing the path length of the other of the loop portions an amount equal to the given amount; and, k. reverse web motion arresting means carried by the structure and positioned along the path at a location downstream from the loop-establishing elements and upstream from the station to clamp a web and prevent retractive web motion toward the loop portions as the loop size control means is operated to shift the loop-establishing elements.

14. The machine of claim 13 wherein at least a majority of the elements are rolls.

15. The machine of claim 13 wherein a path length adjustment mechanism is positioned along the path between said section and the station and is adapted to adjust the path length between the section and the station for adjusting the length of a web run between the section and the station whereby a bag to be loaded and a web portion to be imprinted may be concurrently registered respectively in the station and in the section.

16. The machine of claim 13 wherein the opposed set clamping means comprises a pair of air cylinders.

17. The machine of claim 13 wherein one of the elements of one of the sets is a print head.

18. The machine of claim 13 wherein the loop size control means includes a pivotally mounted teeter-totter which rotatably supports the loop-establishing elements and a power means selectively to effect pivotal movement of the teeter-totter.

19. The machine of claim 18 wherein the power means is an air cylinder.

20. The machine of claim 13 wherein at least one of the elements is a feed roll and wherein the arresting means is a drive mechanism connected to the feed roll for selectively causing and preventing feed roll rotation.

21. A packaging machine comprising:

a. a housing and frame structure having web supply and packaging stations;

b. motor driven feed rolls carried by the structure near the packaging station for pulling a web to feed it from the supply station along a path of travel to the packaging station;

c. a control carried by the structure, the control being adapted to sense a desired positioning of a packaging portion of the web at the packaging station and to emit a motor control signal when a desired positioning has been achieved;

d. the control being connected to the feed roll motor drive to cause the motor to terminate web feed in response to a motor control signal;

e. an imprinter assembly carried by the structure and positioned along the path upstream from the feed rolls, the assembly including imprinter control electronics connected to the control;

f. the assembly including at least two stepper motor driven roll elements and at least two clamp elements, each of the roll elements being paired with a corresponding one of the clamp elements to provide a plurality of web section control sets, the elements of each set being disposed on opposite sides of the path;

g. clamp means operatively connected to each of the control sets selectively to effect relative movement of the elements of each set from a web clamped, section feed control position to a spaced position permitting free web feed therebetween when the feed rolls are operating;

h. the electronics including an enablement means connected to the control and responsive to motor control signals, the enablement means being adapted to enable imprinter assembly operation in response to such signals; and, i. the electronics being connected to the clamp means and adapted to actuate the clamp means to shift the elements of each set from their spaced to their feed control positions after enablement in response to receipt of a motor control signal.

22. The machine of claim 21 wherein one of the clamp elements is a print head.

23. The machine of claim 21 wherein the control includes a spark gap detector.

24. The machine of claim 21 wherein a path length adjustment mechanism is positioned along the path between the assembly and the station and is adapted to adjust the path length between the section and the packaging station for adjusting the length of a web run between the assembly and the packaging station whereby a bag to be loaded and a web portion to be imprinted may be concurrently registered respectively in the packaging station and adjacent the assembly.

25. The machine of claim 21 wherein the opposed set clamp means comprises a pair of air cylinders.

26. The machine of claim 21 wherein the machine comprises multiple imprinter assemblies mounted in a juxtaposed relationship.

27. The machine of claim 21 wherein loop delineating elements are carried by the structure and positioned along the path to delineate a pair of accumulator loops, one of which is upstream of and the other of which is downstream of the assembly.

28. The machine of claim 27 wherein a loop size control means is interposed between the loop delineating elements and the structure.

29. The machine of claim 28 wherein the loop size control means includes a pivotally mounted teeter-totter which rotatably supports the loop-establishing elements and a power means selectively to effect pivotal movement of the teeter-totter.

30. An imprinter for use with a packaging machine or the like comprising:

a. a housing of generally rectangular solid configuration having a transverse dimension and a lengthwise dimension substantially greater than its transverse dimension;

b. the housing having generally flat side walls each adapted to be juxtaposed against a like imprinter whereby a plurality of such imprinters may be operated in coordinated fashion on a workpiece;

c. the housing a base adapted to be positioned adjacent a workpiece path of travel when the imprinter is in use;

d. a print head mounted in the housing near the base and having a transverse dimension only slightly smaller than the transverse dimension of the housing;

e. foil supply and take-up reel supports mounted in the housing at supply and take-up locations and spaced further from the base than the print head when the imprinter is in use, the supports being adapted to receive spools of foil at spaced locations, such foil being of a width substantially equal to the transverse dimension of the print head;

f. a reel drive mounted within the housing at a location offset from the supports;

g. narrow drive transmission means having portions interposed between each reel location and respective slightly spaced side wall portions, the drive transmission means being operatively interconnected to the drive and the support for take-up of foil;

h. electronics mounted in the housing further from the base than the drive and the supports;

i. the supports, the print head and other structure defining a foil path of travel from the supply location to the take-up location and including a path section along the base; and, j. static electric shielding interposed between the path and the electronics.

31. The imprinter of claim 30 wherein the housing has a vertical dimension when the base is horizontal which is substantially greater than both the housing lengthwise and transverse dimensions.

32. The imprinter of claim 20 wherein the housing includes transversely disposed end walls and wherein one of the end walls carries an imprinter control panel.

* * * * *

UNITED STATES PATENT AND TRADEMARK OFFICE

CERTIFICATE OF CORRECTION

PATENT NO. : 5,371,521

DATED : December 6, 1994

INVENTOR(S) : Wehrmann

It is certified that error appears in the above-identified patent and that said Letters Patent is hereby corrected as shown below:

Item [21], Title page, the Appl. No. should read — 861,587 —

Signed and Sealed this

Eighteenth Day of April, 1995

Bruce Lehman

*Attest:*

BRUCE LEHMAN

*Commissioner of Patents and Trademarks*

*Attesting Officer*